US006523292B2

(12) United States Patent
Slavik

(10) Patent No.: US 6,523,292 B2
(45) Date of Patent: Feb. 25, 2003

(54) CLIP CARD

(76) Inventor: Brenda L. Slavik, 2971 Melbourne La., Lake In The Hills, IL (US) 60102

( * ) Notice: Subject to any disclaimer, the term of this patent is extended or adjusted under 35 U.S.C. 154(b) by 0 days.

(21) Appl. No.: 09/737,081

(22) Filed: Dec. 14, 2000

(65) Prior Publication Data

US 2002/0095844 A1 Jul. 25, 2002

(51) Int. Cl.[7] ..... G09F 3/16; G09F 3/20

(52) U.S. Cl. ..... 40/666; 40/652; 40/647; 40/658; 248/274.1; 248/276.1; 248/316.7

(58) Field of Search ..... 40/666, 645, 658, 40/647, 652; 248/160, 274.1, 276.1, 316.7

(56) References Cited

U.S. PATENT DOCUMENTS

| | | | | | |
|---|---|---|---|---|---|
| 1,224,431 | A | * | 5/1917 | Van Vorst | 248/274.1 |
| 1,690,284 | A | * | 11/1928 | Doty | 248/299.1 |
| 3,877,165 | A | * | 4/1975 | Lumbard | 40/779 |
| 4,584,213 | A | | 4/1986 | Rentowl | |
| 4,828,151 | A | * | 5/1989 | Goss | 224/438 |
| D319,474 | S | | 8/1991 | Steiner | |
| 5,088,216 | A | | 2/1992 | Wasilko | |
| 5,335,796 | A | | 8/1994 | Sanford | |
| 5,366,192 | A | | 11/1994 | Carroll | |
| 5,479,735 | A | * | 1/1996 | Martin, Jr. | 40/593 |
| 5,495,644 | A | | 3/1996 | Mesher | |
| 5,613,602 | A | | 3/1997 | Lage et al. | |
| 5,666,702 | A | | 9/1997 | Ming-Chieh | |
| D400,595 | S | | 11/1998 | Hyde | |
| 5,884,888 | A | | 3/1999 | Grimes | |
| 5,913,502 | A | | 6/1999 | Smith | |
| 6,269,573 | B1 | * | 8/2001 | Najmi | 40/666 |

* cited by examiner

*Primary Examiner*—Cassandra H. Davis
(74) *Attorney, Agent, or Firm*—Meroni & Meroni, P.C.; Charles F. Meroni, Jr.; Paul D. Pressley

(57) ABSTRACT

A printed greeting card is placed within a two-sided frame-like casing which is suspended in a vertical plane such that both sides of the greeting card can be viewed. The casing extends from a combination elongate connector strand and clip. The clip can be releasably attached to any element in a floral arrangement, to a single floral stem, as well as to other gifts such as stuffed animals or gift bags. The greeting card may be a flat card with printing on one or both sides, or may alternatively be folded in half in the fashion of traditional hand-held greeting cards. In all cases, the greeting card is placed within the frame-like casing by insertion through a slot in the side of the casing so that both exterior surfaces are easily viewable.

10 Claims, 11 Drawing Sheets

CLIP CARD

BACKGROUND OF THE INVENTION

Traditionally, complimentary cards have been provided by florists for insertion into floral arrangements. These cards are normally mounted within the arrangement by placing them on a stemmed bracket, the stem of which is then inserted into the mounting medium within the arrangement, or placed among the floral stems within a vase. This presentation of the card by the florist has been in use for many years and can be considered outdated.

Additionally, this presentation is not suitable for use with a single-stemmed floral gift, where the inclusion of a card mounted on a stemmed bracket detracts from the beauty of the gift.

An updated, fun, and modern device is needed to present a gift card in floral arrangements and in the presentation of a single floral stem.

SUMMARY OF THE INVENTION

The inventive clip card is a means by which gift cards can be presented in a novel, modern, and colorful way. A printed greeting card is placed within a two-sided frame-like casing which is suspended in a vertical plane such that both sides of the greeting card can be viewed. The casing extends from a combination elongate connector strand and clip. The clip can be releasably attached to any element in a floral arrangement, to a single floral stem, as well as to other gifts such as stuffed animals or gift bags.

The greeting card may be preprinted with customary phrases, such as "Happy Birthday," "I'm sorry," and "Get Well Soon!" among others. The greeting card may also include appropriate colorful images to accompany the printed message, or may provide a colorful image without text. The greeting card may be a flat card with printing on one or both sides, or may alternatively be folded in half in the fashion of traditional hand-held greeting cards. The folded embodiment may include printing on one or both exterior and one or both interior surfaces. The interior surfaces may also be left blank to allow a private handwritten inscription to be placed thereon. In all cases, the greeting card is placed within the frame-like casing by insertion through a slot in the side of the casing so that both exterior surfaces are easily viewable.

Although originally conceived as a means of updating the presentation of the complimentary floral gift card, the inventive clip card may be used in a variety of alternative ways. For example, a printed photograph may be substituted for the greeting card within the casing. In this instance, the casing may still be attached to a floral piece or other gift, or may also be attached to clothing such as a shirt lapel, pocket, or hat band or visor. In a second example, a name tag may be substituted for the greeting card. In this instance, the casing may still be attached to a floral piece or other gift for use as a place card, or may also be attached to clothing such as a shirt lapel, pocket, or hat band or visor for use in self-introduction/identification. In a third example, a label or price tag may be substituted for the greeting card. In this instance, the casing may be used in a retail environment to draw attention to a new item, or a sale item, and would be attached directly to the item or to a rack adjacent to the item

DETAILED DESCRIPTION

Figure 1:
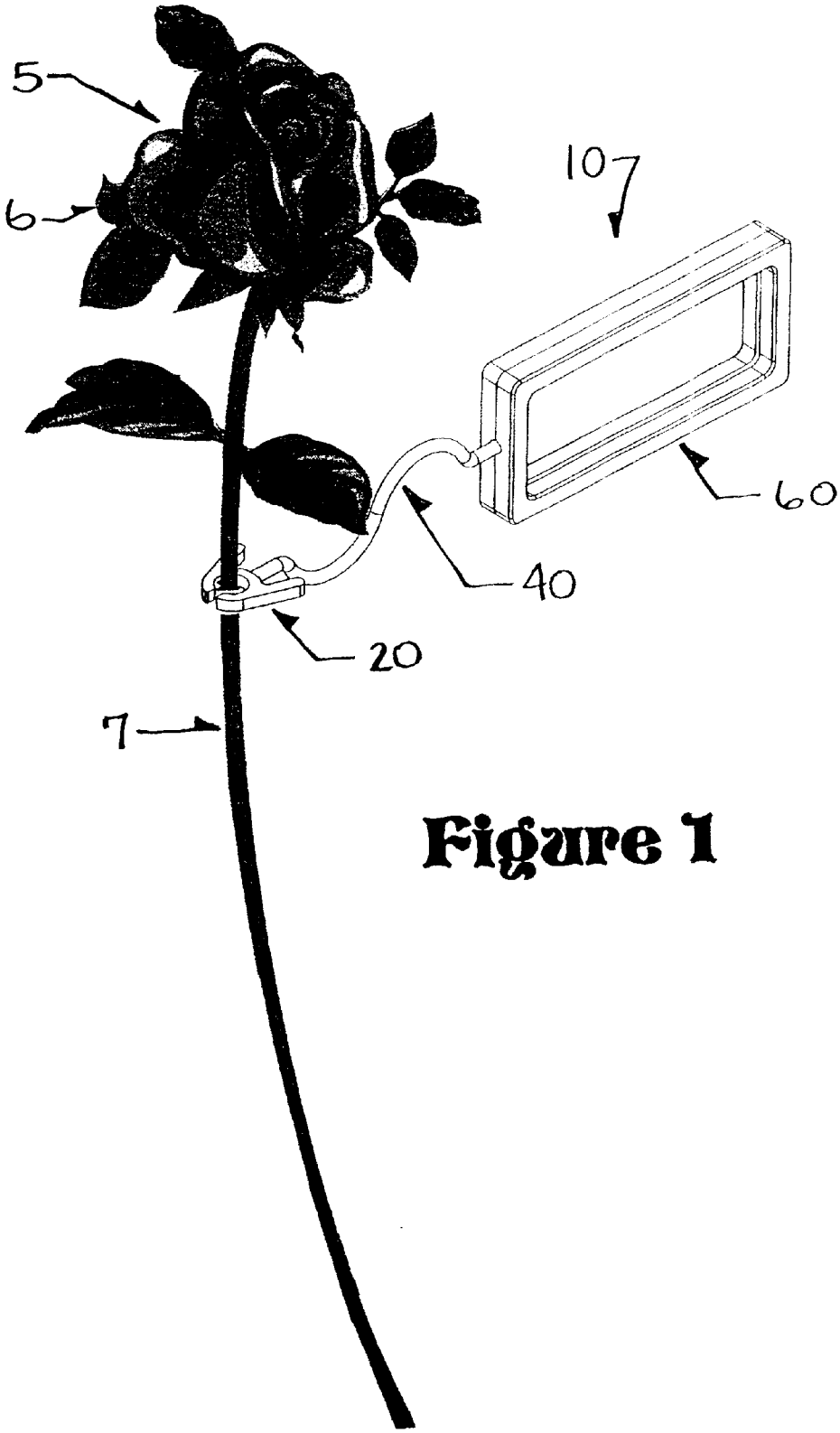
FIG. 1 is a front perspective view of the clip card illustrating how the clip card is secured to a generally vertical support structure such as a flower stem so that the message held by the clip card is displayed.
Figure 2:
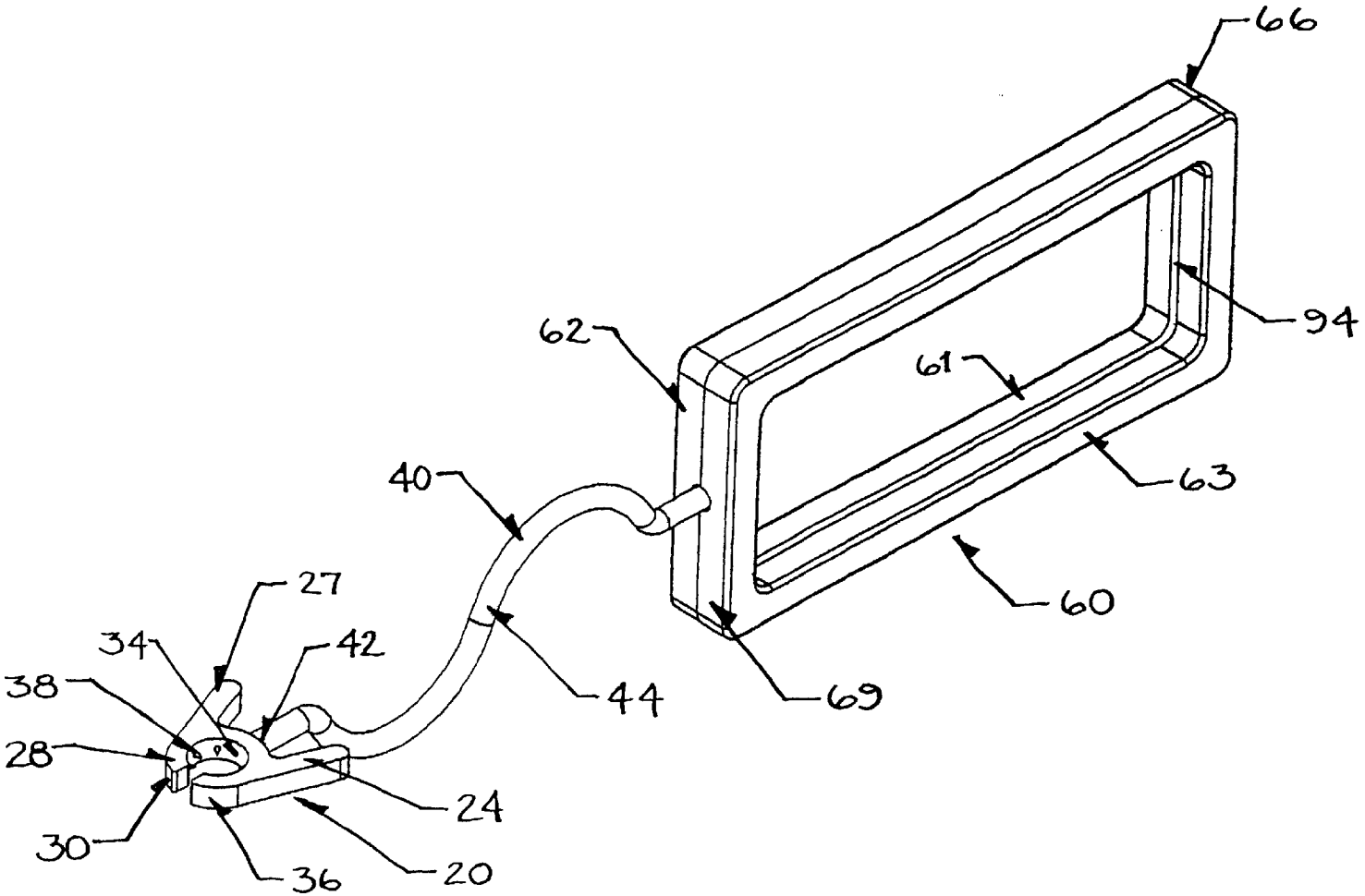
FIG. 2 is a front perspective view of the clip card.

The inventive clip card will now be described with respect to the figures. A first embodiment 10 of the clip card is shown in FIGS. 1–9 and 14. First embodiment 10 of the clip card is composed of a rectangular frame-like casing 60, a spring clip 20, and a connector strand 40 which allows casing 60 to be suspended from clip 20.

Casing 60 is a thin, hollow rectangular frame which provides a means for holding an imprinted card 100 in a vertical orientation in space. Casing 60 is two sided so that both sides of card 100 can be viewed. Casing 60 surrounds and encloses the peripheral edges 130 only of card 100 in the fashion of a border, and is open and hollow in its center so as to allow an unobstructed view of both front 110 and rear 120 faces of card 100.

Casing 60 is formed of a first hollow rectangular frame 61 and a second hollow rectangular frame 63, the first hollow frame 61 having the same size and exterior shape as the second hollow frame 63.

First hollow frame 61 is provided with a first outer face 71, and a first inner face 70 which lies opposed to first outer face 71. First hollow frame 61 is also provided with a first end 62 and a second end 66 which is opposed to first end 62. Mid portion 64, which extends between first end 62 and second end 66, is the interior region bounded by the peripheral edge 68, and is void of material in locations which are space apart from the peripheral edge so as to form an open or hollow central space. First hollow frame 61 has a first outside edge 68 which corresponds to its periphery, and a first inside edge 67 which corresponds to the surface resulting from the absence of material in mid portion 64. First outside edge 68 is opposed to first inside edge 67.

Second hollow frame 63 is provided with a second outer face 73, and a second inner face 72 which lies opposed to second outer face 73. Second hollow frame 63 is also provided with a first end 86 and a second end 87 which is opposed to first end 86. Mid portion 88, which extends between first end 86 and second end 87, is the interior region bounded by the peripheral edge 77, and is void of material in locations which are space apart from the peripheral edge so as to form an open or hollow central space. Second hollow frame 63 has a first outside edge 77 which corresponds to its periphery, and a first inside edge 78 which corresponds to the surface resulting from the absence of material in mid portion 88. First outside edge 77 is opposed to first inside edge 78.

The two frames 61, 63 are formed in an unfolded configuration and are joined along one side of their respective rectangular peripheries 68, 77 by means of strip 90. Casing 60 is formed by folding strip 90 along fold line 92 (FIG. 4) such that the respective inner faces 70, 72 are adjacent and confronting, and such that the respective first ends 62, 86 are adjacent to each other, and such that the respective peripheral edges 68, 77 are aligned to form a single, smooth outer casing edge.

Casing 60 is maintained in the folded configuration by means of a plurality of snap fittings 80 formed in the respective inner faces 70, 72. In the preferred embodiment, two snap fitting pairs 80 are provided along the peripheral edge of each frame 61, 63 in a location which is distant from the fold strip 90. However, it is well within the scope of this invention to use more or fewer snap fitting pairs as required to achieve a pleasing, uniform external appearance.

Each snap fitting pair 80 is comprised of two mating members which are sized and shaped to snap together when aligned under external pressure. In the preferred embodiment, the first member of the pair is a cylindrical post 85 which is sized to be received within the second member, cylindrical ring 81.

Figure 3:
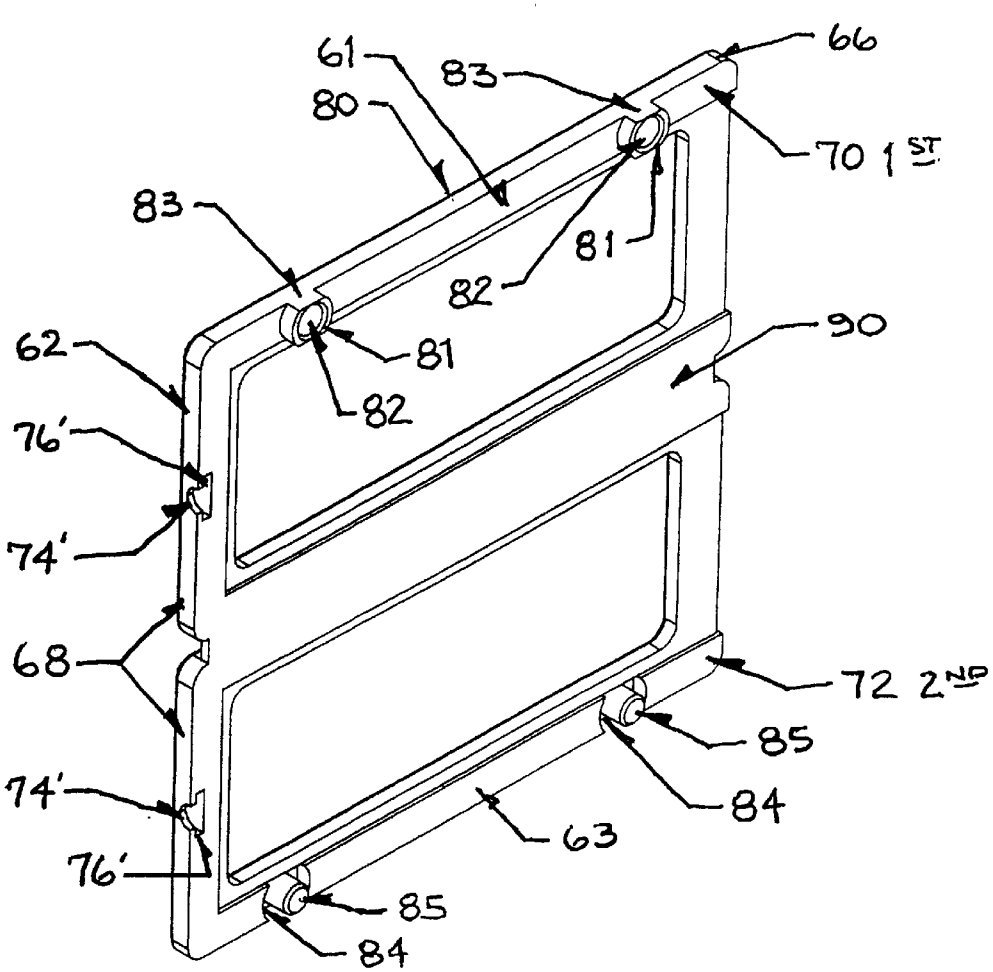
FIG. 3 is a perspective view of the opened card case showing the snap fitting pairs which allow the card case to be selectively opened and secured in a closed, folded position.
Figure 4:
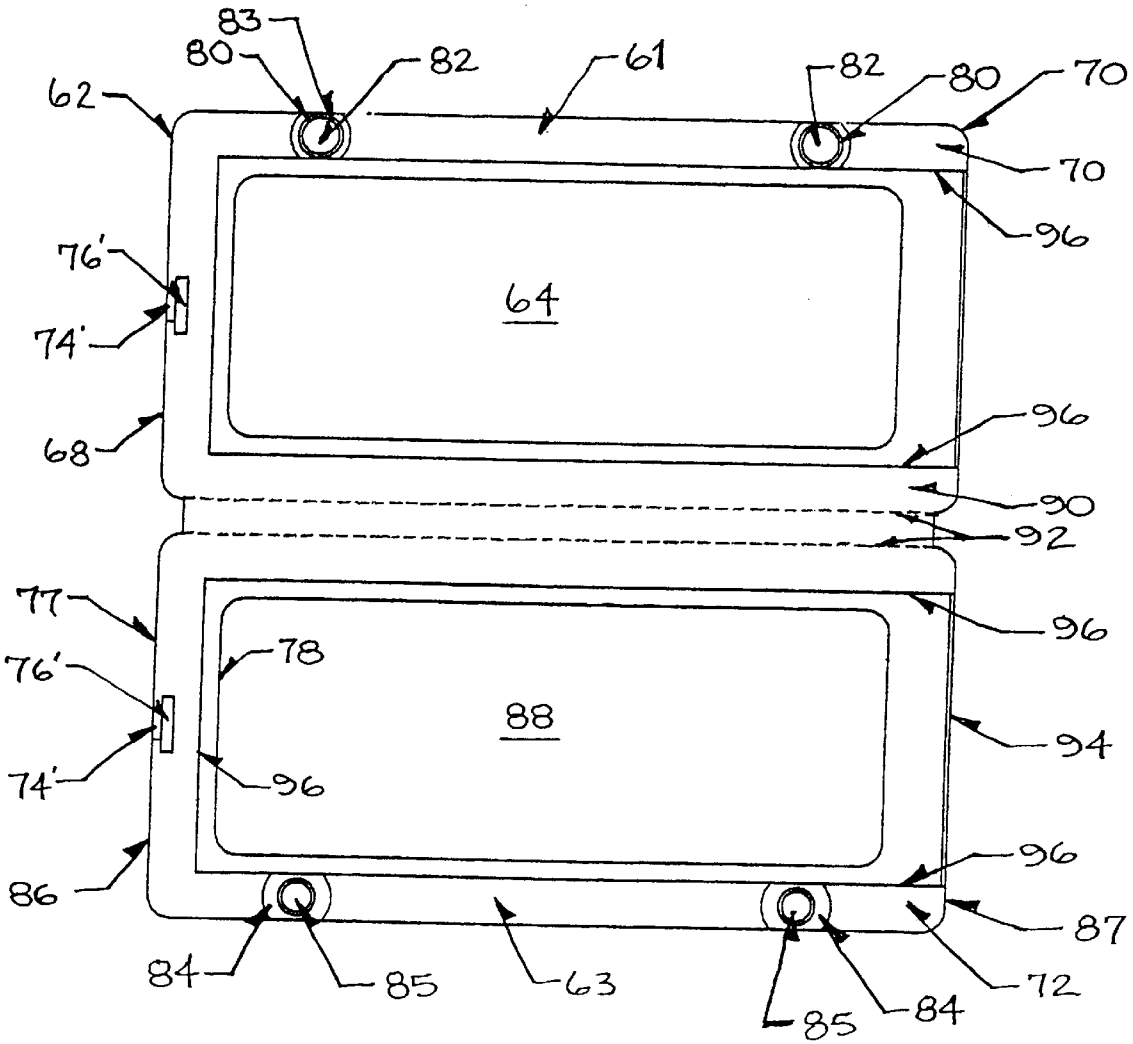
FIG. 4 is a front view of the opened card case showing the fold line in phantom and showing the channel and vacancy in the first end which receives one end of the flexible connector strand therein.
Figure 5:
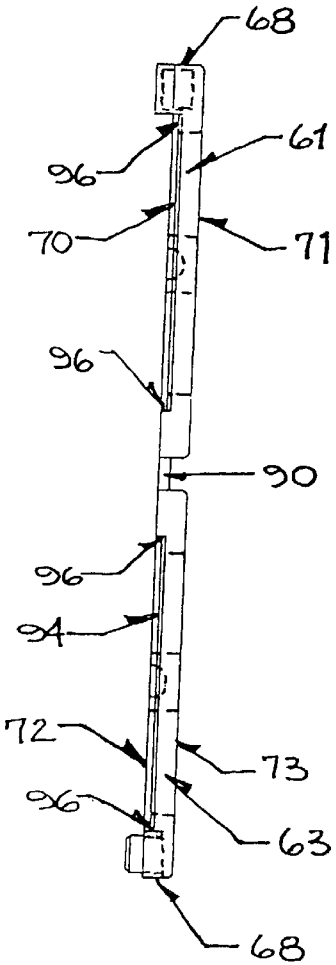
FIG. 5 is a side view of the opened card case.
Figure 6:
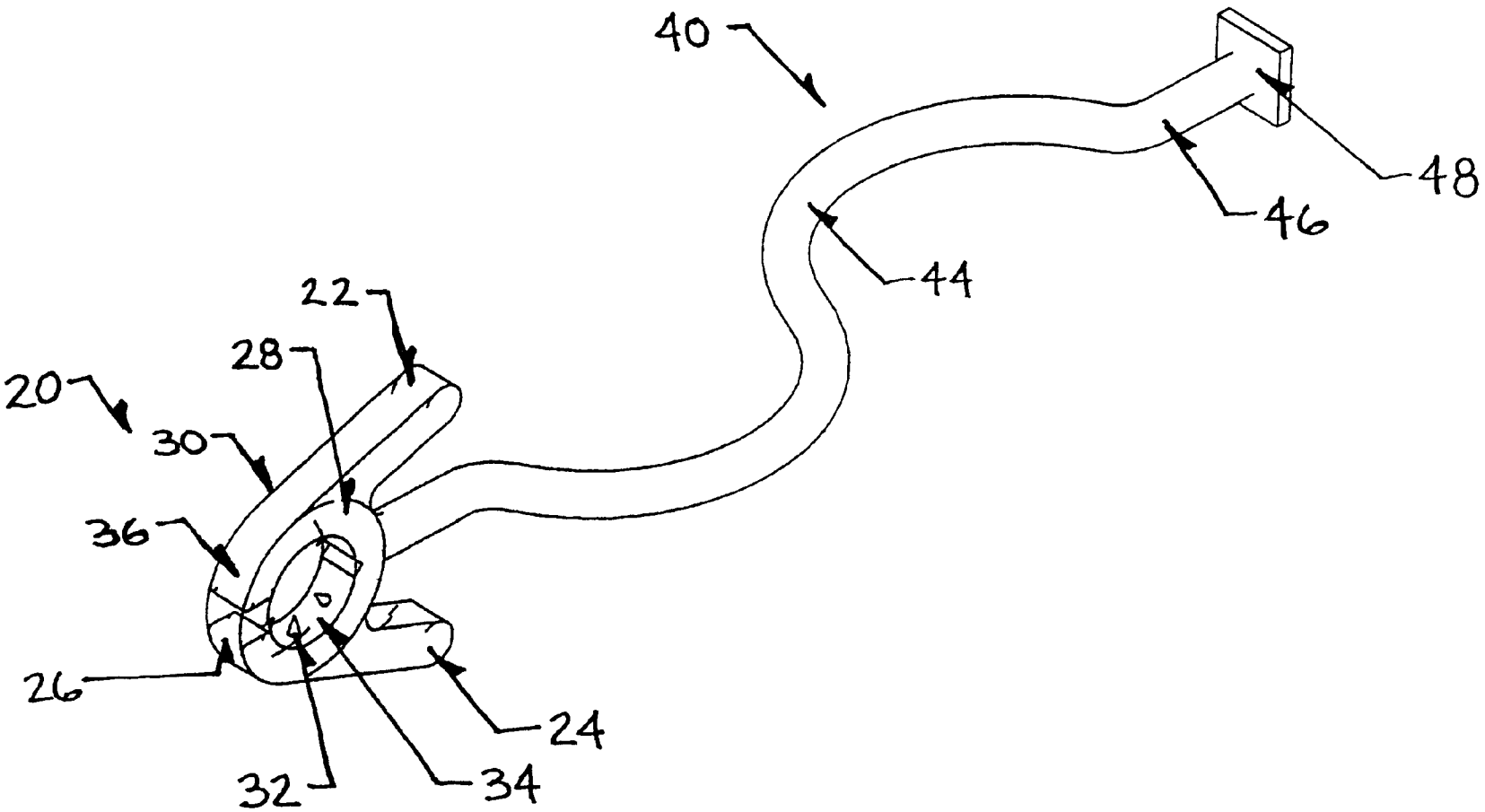
FIG. 6 is a front perspective view of the clip and connector strand showing the widened end on the second end of the connector strand which is used to secure the connector strand to the card case.
Figure 7:
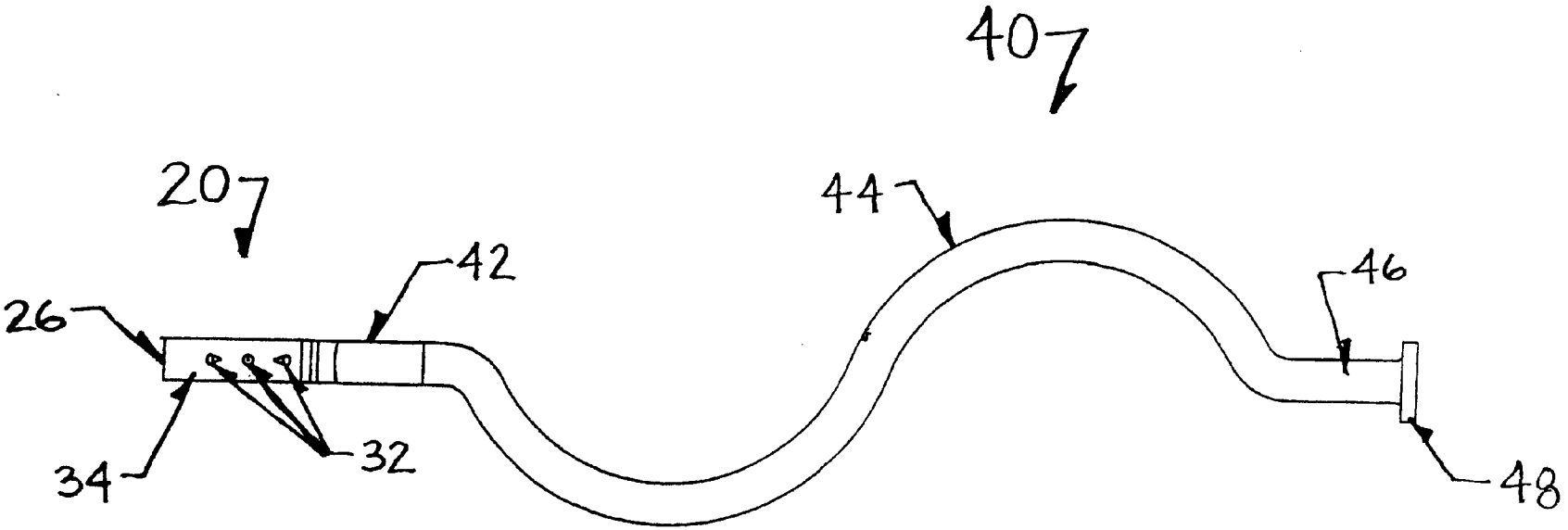
FIG. 7 is a side sectional view of the clip and connector strand showing the profile of the widened end on the connector strand and showing the teeth which are provided on the interior surface of the clip.
Figure 8:
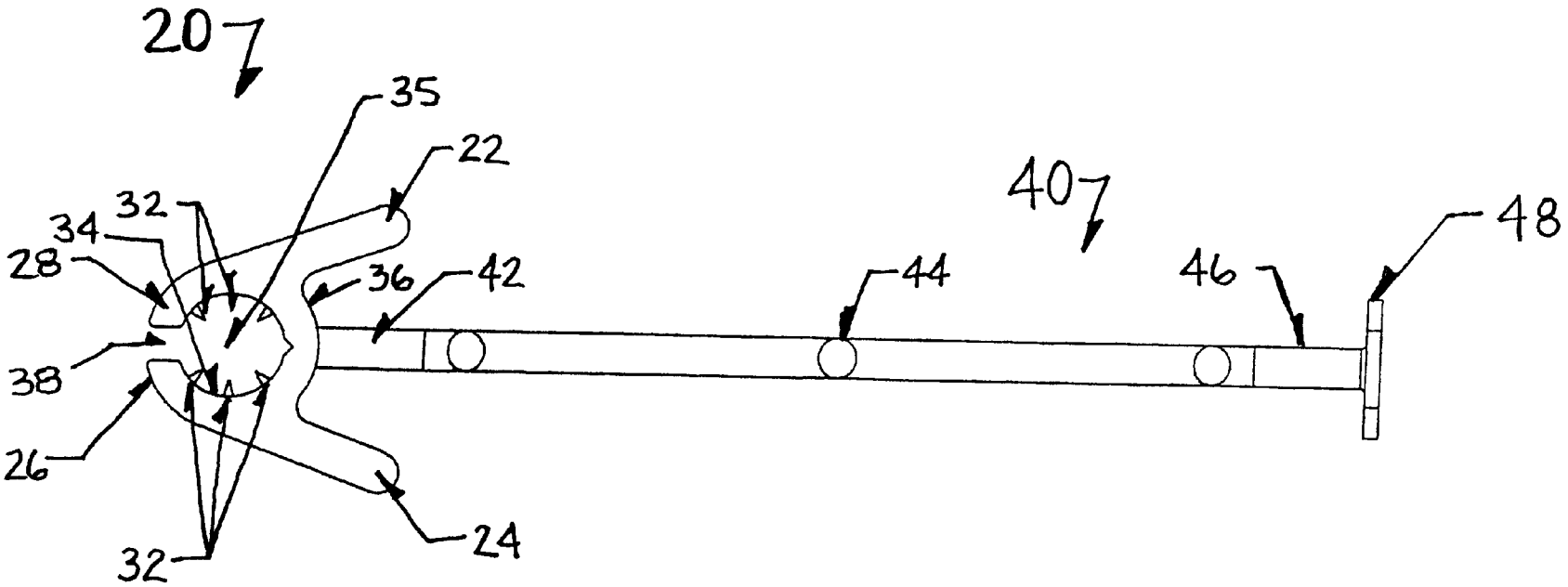
FIG. 8 is a top view of the clip and connector strand showing the profile of the clip.

As illustrated in FIG. 3, first inner face 70 of first hollow frame 61 is provided with two cylindrical rings 81. Each ring 81 is positioned between peripheral edge 68 and inside edge 67 on first inner face 70, and is located on the side of the rectangle which is distant from fold strip 90. The inner diameter of each ring 81 is sized to receive the post therewithin in a close fit. The outer diameter of ring 81 is slightly larger than distance between peripheral edge 68 and inside edge 67, and is therefore flattened along portions which intersect peripheral edge 68 (see reference number 83 in FIGS. 3 and 4) and inside edge 67. This truncation of the outer perimeter of ring 81 preserves the smooth appearance of casing 60 when assembled.

Second inner face 72 of second hollow frame 63 is provided with two cylindrical posts 85. Each post 85 is positioned between peripheral edge 77 and inside edge 78 on second inner face 72, is located on the side of the rectangle which is distant from fold strip 90, and are positioned to mate with the associated ring 81 when casing 60 is folded. Ring-shaped channel 84 is formed in second inner face 72 about each post 85, and is sized to fittingly receive ring 81 therewithin as post 85 is inserted into the inner diameter of ring 81.

Casing 60 is provided with a pair of channels or slots 74' in the respective inner faces 70, 72 along first ends 62, 86 of the hollow frames 61, 63. Channels 74' extend inward from the respective peripheral edges 68, 77 at a location which is approximately centered on the first ends 62, 86. Channels 74' extend inward to intercept a vacancy 76' formed in each of the inner faces 70, 72 adjacent to the peripheral edges 68, 77. Vacancies 76' are elongate channels or slots which extend in a direction which is perpendicular to channels 74'. When casing 60 is in the folded configuration, channel 74' of first inner face 70 overlies and confronts channel 74' of second inner face 72 so as to form a single, cylindrical channel 74. Likewise, when casing 60 is in the folded configuration, vacancy 76' of first inner face 70 overlies and confronts vacancy 76' of second inner face 72 so as to form a single rectangular channel 76. Channel 74 and vacancy 76 provide a means for securing connector strand 40 to casing 60.

Casing 60 is provided with a pair of shallow rectangular channels 96' in the respective inner faces 70, 72 of the hollow frames 61, 63. Channels 96' originate from the respective second ends 66, 87 and extend along the respective inner faces 70, 72 to surround respective mid portions 64, 88 so as to form a recess within the respective inner faces 70, 72 in the region of respective mid portions 64, 88. When casing 60 is in the folded configuration, channel 96' of first inner face 70 aligns with, overlies, and confronts channel 96' of second inner face 72 so as to form a single channel 96 which is sized and shaped to receive and maintain a greeting card 100 therein. The intersection of channel 96 with respective second ends 66, 87 results in slot 94. Slot 94 allows greeting card 100 to be inserted into, and removed from, casing 60 when the casing is completely assembled in the folded configuration.

Figure 10:
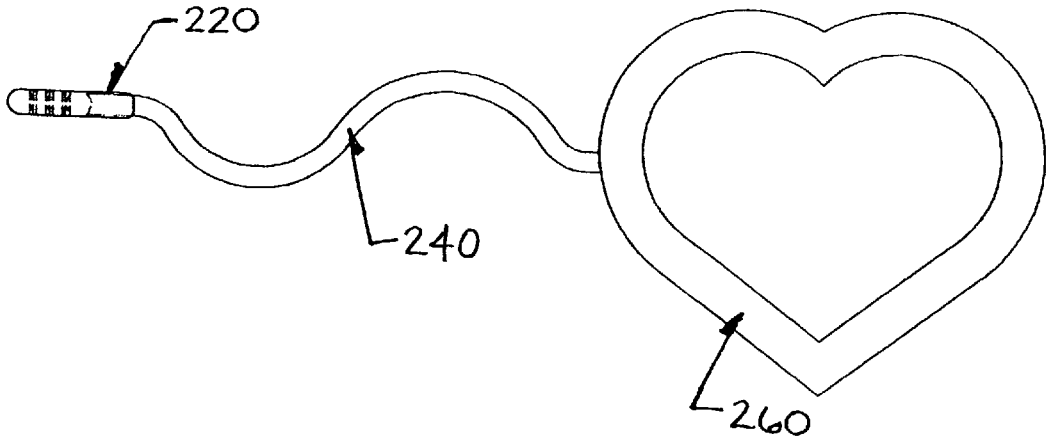
FIG. 10 is a second embodiment of the clip card illustrating the card case formed in the shape of a heart.
Figure 11:
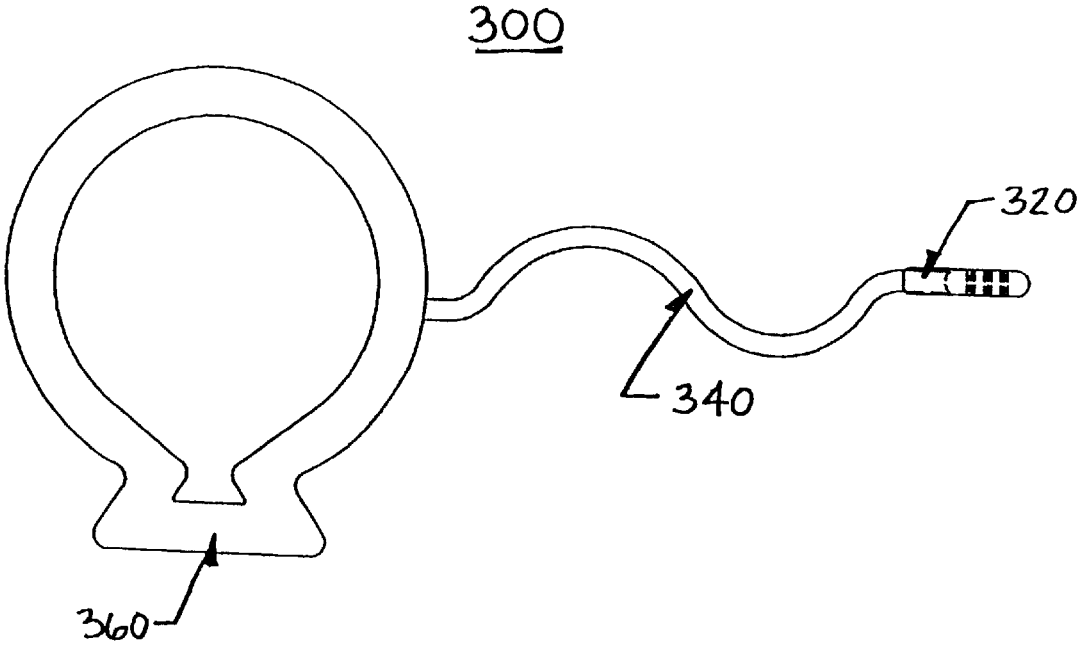
FIG. 11 is a third embodiment of the clip card illustrating the card case formed in the shape of a balloon.

Casing 60 is described herein as rectangular is shape. It is well within the scope of this invention, however, to provide a casing which is formed in alternative shapes, For example, a second embodiment 200 is illustrated in FIG. 10 which provides a heart-shaped casing 260 suspended from clip 220 by connector strand 240. A third embodiment 300 is illustrated in FIG. 11 which provides a balloon shaped casing 360 suspended from clip 320 by connector strand 340. Alternate shapes are not limited to those specifically illustrated herein, and may include, but are not limited to, shapes which are associated with special events, occasions, and/or holidays such as egg shaped or bunny shaped to commemorate the Easter holiday, turkey shaped to commemorate Thanksgiving, and balloon or cake shaped to commemorate birthdays. Additionally, a casing may be provided in a shape which has no special meaning but which is fun in nature, such as, but not limited to, the shape of a flower, fruit, animal and/or fictitious character.

Figure 9:
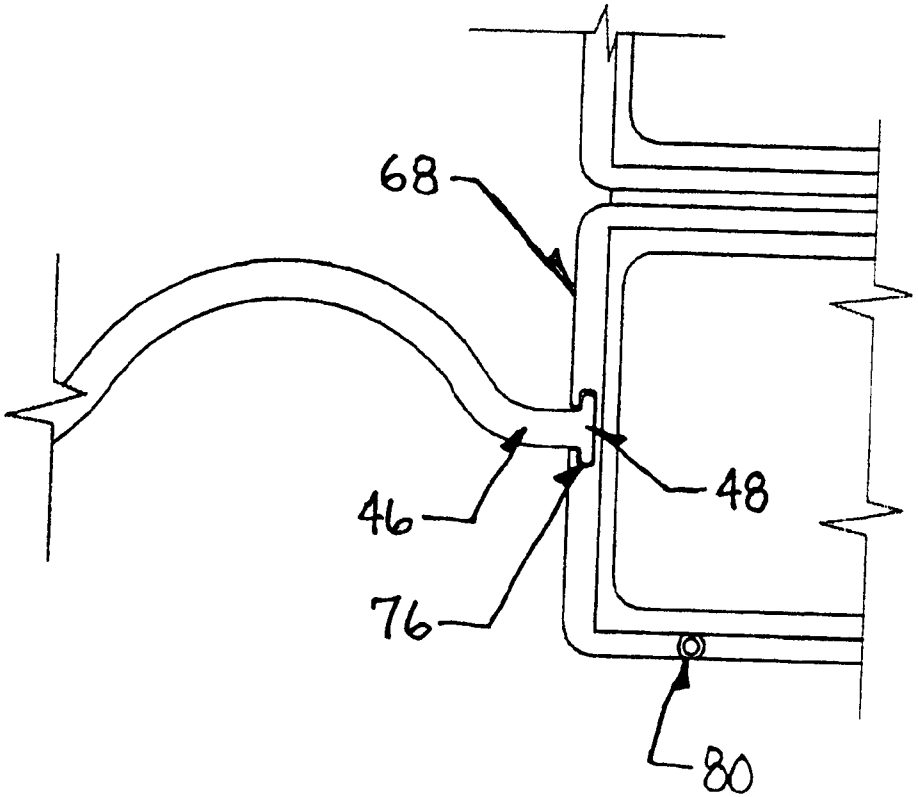
FIG. 9 is a partial sectional view of the card case illustrating the way in which the widened end of the connector strand is secured in the end of the card case.

Connector strand 40 is an elongate, curvilinear strand which is has a first end 42 which extends from clip 20, a second end 46 which is opposed to first end 42, and a body portion 44 which lies between and separates first end 42 from second end 46. In the preferred embodiment, connector strand 40 is provided in the specific shape described as follows: First end 42 and second end 46 of connector strand 40 are colinear along a longitudinal axis and separated by body portion 44 which is formed in the shape of the letter "S" or of a sine curve. Second end 46 of connector strand 40 terminates in a widened portion or stop 48. Stop 48 is elongate and is preferably formed in the shape of a rectangular plate which lies normal to the longitudinal axis. Second end 46 is received within channel 74 of casing 60, and stop 48 is shaped and sized to be received within vacancy 76. When casing 60 is assembled with second end 46 and stop 48 residing within channels 74 and 76, respectively, connector strand 40 cannot be withdrawn from channel 74, and is thus secured to casing 60. Additionally, the elongate shape of stop 48 as nested in vacancy 76 provides a means by which connector strand 40 is prevented from translation in a direction parallel to the longitudinal axis, as well as prevented from rotation about this axis (FIG. 9).

Connector strand 40 is both flexible and resilient. In the preferred embodiment, it is formed of plastic and is provided with enough stiffness to allow casing 60 to be suspended in space at a location which is a short distance apart from clip 20, and maintained in a desired orientation, preferably vertical Additionally, connector strand 40 is provided with enough flexibility so that the displayed message is capable of some deflection of casing 60 relative to clip 20, and enough resilience to regain the desired orientation following any motion. Plastic is the preferred material due to its stiffness properties, its low weight, and because it is relatively inexpensive to use. However, it is well within the scope of this invention to use any alternative materials to form connector strand 40 which would provide the same material properties.

Clip 20 extends from first end 42 of connector strand 40 and acts to secure casing 60 to a desired object. Clip 20 is a resilient spring and is comprised of a flat hollow cylinder, the cylinder comprising a wall which defines an inner surface 34, an outer surface 36, a top edge 28, and bottom edge 30, the cylinder further comprising a discontinuity 38 such that a portion of the wall is open, the cylinder being attached to connector strand 40 at a location which is opposed to the discontinuity.

Clip 20 is also provided with a first elongate finger tab 22 and a second elongate finger tab 24, each of the first 22 and second 24 elongate finger tabs extending tangentially outward from the outer surface 36 adjacent to the discontinuity 38 in the direction of connector strand 40 such that first end 42 of connector strand 40 is bracketed between the finger tabs. The inner surface 34 of the cylinder is provided with a plurality of teeth 32 which extend radially inward from the inner surface. Teeth 32, and the spring tension of the cylindrical wall provide the means by which clip 20 is able to successfully grip an external object.

In the preferred embodiment, first outer face 71 of casing 60 defines a first plane, and is presented to the viewer in a vertical orientation. The "S" shaped curve of connector strand 40 defines a second plane or strand plane. This second plane preferably lies parallel to the first plane. A third plane is defined by the top edge 28 of clip 20. In the preferred embodiment, clip 20 extends from first end 42 of connector strand 40 such that the third plane defined by top edge 28 of clip 20 lies perpendicular to the both the second plane defined by the curvilinear connector strand 40, and the first plane defined by the first outer face 71 of casing 60. That is, when clip card 10 is in use, top edge 28 of clip 20 lies in the horizontal plane.

In operation, clip 20 is manually opened by applying force to the distal ends of the finger tabs 22, 24 which causes discontinuity 38 to widen. The object to which the clip card 10 is to be attached is passed through discontinuity 38 and positioned within interior space 35, and then clip 20 is allowed to close about the object by removing the force from the distal ends of the finger tabs 22, 24. FIG. 1 illustrates clip card 10 suspended from the stem 7 of a rose 5. The circular shape of interior space 35 in combination with teeth 32 extending from the inner surface 34 of clip 20, are designed to receive the cylindrical stem and grip it so that clip card 10 remains in the desired position without vertical slipping or rotation about a vertical axis.

Although specifically designed to receive a cylindrical object therein, clip 20 is also well suited for attachment to objects which are not cylindrical in shape due to its spring design. It is well within the scope of this invention to use clip 20 to attach clip card 10 to a wide variety of objects which include, but are not limited to, gift packages, clothing, furniture and office equipment.

Figure 13:
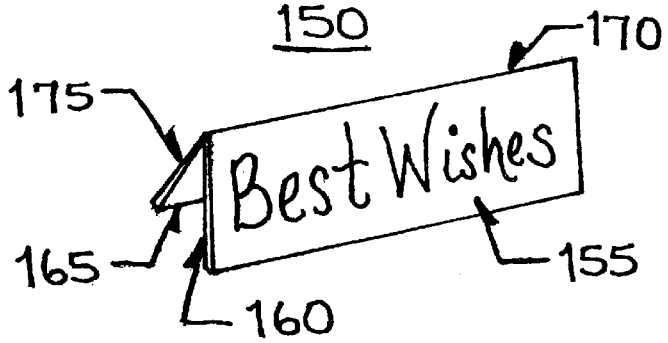
FIG. 13 is a perspective view of a folded greeting card for use with the inventive casing.
Figure 14:
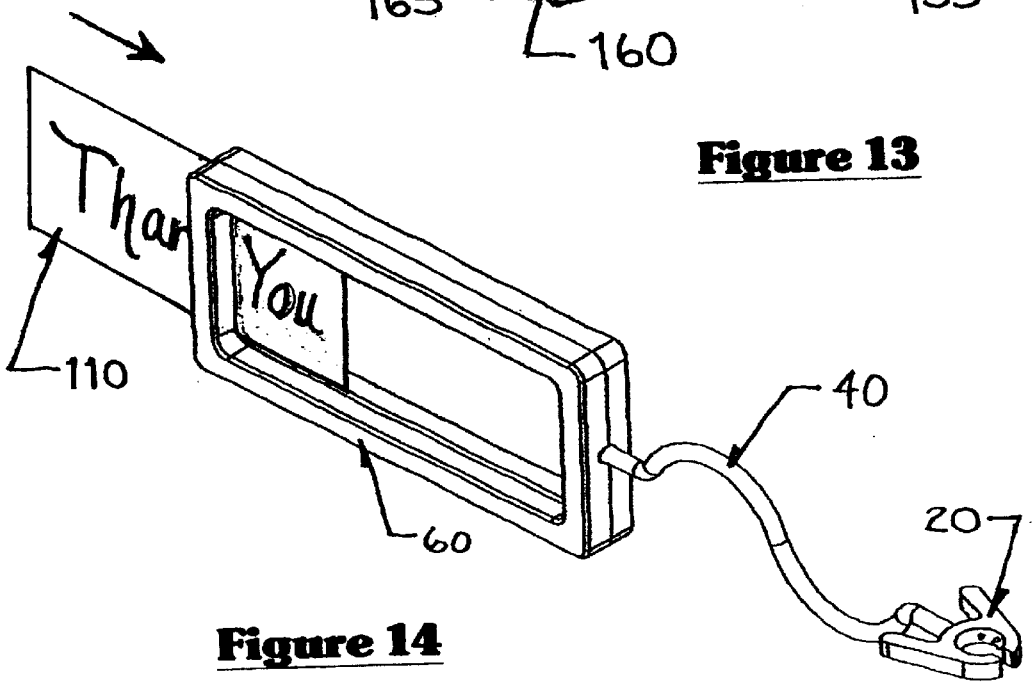
FIG. 14 is a perspective view of the flat greeting card of FIG. 12 being inserted into the casing, where the arrow shows the direction of movement of the card.
Figure 12:
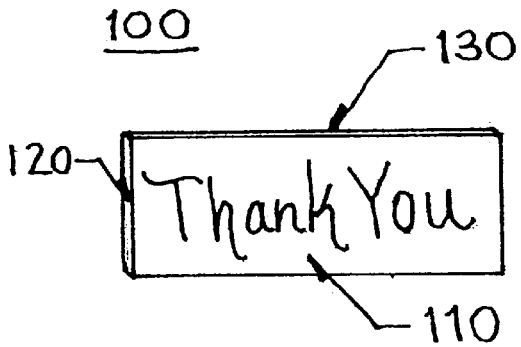
FIG. 12 is a perspective view of a flat greeting card for use with the inventive casing.

As described above, greeting cards 100, 150 are inserted into slot 94 of the assembled clip card 10 so provide a new means of displaying greeting card 100 (FIGS. 12–14). The greeting card 100 may be a single sheet of card stock, and may be imprinted with colorful images and text on one 110 or both 110, 120 sides. In the preferred embodiment, greeting card 150 is folded in the manner of traditional greeting cards along a perforated or scored fold line 170 so as to form a card having a front outside face 155, a rear outside face 175, a front inside face 160 which is opposed to front outside face 155, and a rear inside face 165 which is opposed to rear outside face 175 and confronts front inside face 160. As with traditional greeting cards, some or all faces 155, 175, 160, 165 may be imprinted with colorful images or text. In the preferred embodiment, at least one inside face 160, 165 remains without imprint to allow a private handwritten message to be inscribed thereon.

In the preferred embodiment, casing 60 is rectangular in shape and is approximately 2 inches long, ⅞ inches wide, and 3/16 inches thick Slot 94, which receives greeting card 100, 150 therethrough, is preferably approximately 1/16 inch by ¾ inch. Connector strand 40 is provided with an approximate overall length of 2 inches, and a circular cross section having a diameter of approximately 1/16 inch. Clip 20 is preferably provided in overall dimensions of approximately ½ inch by ½ inch by ⅞1/16 inch. Thus the total overall length of clip card 10 is approximately 4½ inches. It is well within the scope of the invention, however, to form clip card 10 and other embodiments 200, 300 of the clip card having dimensions which are smaller or larger in order to suit any required need.

I claim:

1. A display device for presenting a message, the display device comprising:

message display means comprising a casing having a first hollow frame and a second hollow frame, the first hollow frame having the same size and exterior shape as the second hollow frame, the first hollow frame comprising a first outer face, a first inner face which is opposed to said first outer face, said first hollow frame comprising a first end, a second end which is opposed to said first end, and a mid portion which extends between said first end and said second end, said first hollow frame comprising a first inside edge and a first outside edge, wherein said first outside edge is opposed to said first inside edge, the second hollow frame comprising a second outer face, a second inner face which is opposed to said second outer face, said second hollow frame comprising a first end, a second end which is opposed to said first end, and a mid portion which extends between said first end and said second end, said second hollow frame comprising a second inside edge and a second outside edge, wherein said second outside edge is opposed to said second inside edge, each of the first and second hollow frames being joined along a portion of their respective first and second outside edges, the casing being folded along said portion of respective first, and second outside edges such that, when assembled, the first inner face of said first hollow frame is immediately adjacent to and confronting said second inner face of said second hollow frame, tile folded casing providing a means for holding an imprinted card therebetween, the casing having a first opening within said first end of each respective first and second hollow frames, said first opening being sized to fittingly receive outer diameter of the curvilinear strand therethrough, said first opening being provided with a widened portion adjacent to but spaced apart from said first end of each respective first and second hollow frames, said widened portion of said first opening being sized to receive the widened portion of said second end of said connection means therein;

elongate connection means formed of plastic comprised of a curvilinear strand which is flexible and resilient and is provided with enough stiffness so that the displayed message is held in the desired orientation, the elongate connection means having a first end, a second end, and an outer diameter wherein the first end of the connection means is fixed to and extends from the securement means and the second end of the connection means is provided with a widened portion; and securement means selectively releasable allowing attachment of the display device to an object, the elongate connection means connecting the message display means to the securement means.

2. The display device of claim 1 wherein the securement means is comprised of a resilient spring clip.

3. The display device of claim 2 wherein the resilient plastic clip is comprised of a flat hollow cylindrical ring, the ring comprising a wall which defines an inner surface, an outer surface, a top edge, and bottom edge, the ring further comprising a discontinuity such that a portion of the wall is open, the ring being attached to the connection means at a location which is opposed to the discontinuity, the ring comprising a first elongate finger tab and a second elongate finger tab, each of said first and second elongate finger tabs extending tangentially outward from said ring adjacent to said discontinuity, and the ring comprising a plurality of teeth which extend radially inward from the inner surface.

4. The display device of claim 3 wherein the top edge of the ring defines a first plane, and wherein the first outer face of the casing defines a second plane, and wherein the display device being configured such that the first plane lies perpendicular to the second plane so that when the plastic clip is in use, the top edge of the ring lies in the horizontal plane and the first outer face of the casing is oriented in the vertical plane.

5. The display device of claim 4 wherein the casing is formed in the shape of a rectangle.

6. The display device of claim 4 wherein the casing is formed in the shape of a heart.

7. The display device of claim 4 wherein the casing is formed in the shape of a balloon.

8. A combination display means and graphic card, wherein said display means comprises a casing, a connector, and a clip, and said graphic card comprises flat sheet material having imprinted indicia thereon, the flat sheet material having a first side, a second side opposed the first side, and a thickness which is small compared to the length and width of the material, said casing providing a two-sided frame which receives the graphic card within a hollow portion formed within an interior portion of the two-sided flame, the two-sided frame allowing both said first side and said second side of said graphic card to be viewed, said first face which corresponds to a first side of said two-sided frame, said casing is provided with a second face which corresponds to the opposing side of said two-sided frame, said casing is provided with a peripheral edge which corresponds to the body of said two sided frame and which separates and lies generally perpendicular to said first face and said second face, a first portion of said peripheral edge having a first slot formed therein providing a means for inserting said graphic card into and removing said graphic card from said interior portion of said two-sided frame, said connector comprising an elongate strand which connects said casing to said clip, said connector having a first end, a second end which is opposed to said first end, and a body portion which extends between said first end and said second end, wherein said body portion is formed in the shape of an "S", wherein said first end, said second end and said body portion all lie in a first plane, and wherein said connector is formed of a material which is resilient and flexible, said first end of said connector extends from said clip, and wherein said second end of said connector terminates in a stop, said stop comprising a rectangular plate having dimensions which are greater than that of said second end, said stop lying perpendicular to said second end, a second portion of said peripheral edge is provided with a second slot formed therein, said second slot forming a channel between a vacancy formed within said peripheral edge of said two sided frame, said vacancy lying adjacent to but spaced apart from said the exterior surface of said two sided frame, said second slot sized having dimensions which sized to fittingly receive said second end of said connector therethrough, said second slot further having dimensions which are less than that of the stop, such that when the two sided frame is assembled said stop is positioned within said vacancy, and said second end of said connector resides within said second slot in said peripheral edge and is prevented from being withdrawn from said second slot, said clip comprising a selectively releasable spring fastener.

9. The combination display means and graphic card of claim 8 wherein said graphic card is imprinted with indicia on at least said first side of said graphic card.

10. The combination display means and graphic card of claim 9 wherein said graphic card is folded in half to form a greeting card such that said first side of said graphic card forms an exterior surface of said greeting card, and such that said second side of said graphic card forms an interior surface of said greeting card, wherein at least a portion of said exterior surface of said greeting card is provided with imprinted indicia.

* * * * *